US009788623B1

(12) United States Patent
Chen

(10) Patent No.: US 9,788,623 B1
(45) Date of Patent: Oct. 17, 2017

(54) CASE WITH TRANSPARENT SHELL

(71) Applicant: TRAVELER'S CHOICE TRAVELWARE, Pomona, CA (US)

(72) Inventor: Chenhua Chen, Pomona, CA (US)

(73) Assignee: TRAVELER'S CHOICE, Pomona, CA (US)

( * ) Notice: Subject to any disclaimer, the term of this patent is extended or adjusted under 35 U.S.C. 154(b) by 37 days.

(21) Appl. No.: 15/151,314

(22) Filed: May 10, 2016

(51) Int. Cl.

| | |
|---|---|
| ***A45C 13/36*** | (2006.01) |
| ***A45C 5/02*** | (2006.01) |
| ***A45C 13/10*** | (2006.01) |
| ***A45C 5/03*** | (2006.01) |

(52) U.S. Cl.
CPC ..... *A45C 13/36* (2013.01); *A45C 5/02* (2013.01); *A45C 5/03* (2013.01); *A45C 13/103* (2013.01); *A45C 2005/037* (2013.01); *A45C 2200/10* (2013.01)

(58) Field of Classification Search
CPC ..... A45C 13/36; A45C 3/02; A45C 13/08; A45C 13/103; A45C 13/1069; A45C 2200/10
USPC ..... 190/125
See application file for complete search history.

(56) References Cited

U.S. PATENT DOCUMENTS

| | | | | |
|---|---|---|---|---|
| 7,296,665 | B2 * | 11/2007 | Morszeck | A45C 5/02 150/104 |
| 9,380,845 | B2 * | 7/2016 | Sheikh | A45C 5/03 |
| 2002/0105197 | A1 * | 8/2002 | Unterwagner | B60R 13/04 293/128 |
| 2008/0230158 | A1 * | 9/2008 | Romero | A45C 3/08 150/105 |
| 2009/0250954 | A1 * | 10/2009 | Shaw | B65G 1/02 293/142 |
| 2012/0216927 | A1 * | 8/2012 | Marier | A45C 1/024 150/105 |
| 2012/0325606 | A1 * | 12/2012 | Scicluna | A45C 5/02 190/115 |
| 2013/0001032 | A1 * | 1/2013 | Kuo | A45C 13/42 190/115 |
| 2014/0008164 | A1 * | 1/2014 | Lai | A45C 13/001 190/102 |
| 2014/0224608 | A1 * | 8/2014 | Tang | A45C 5/03 190/124 |
| 2014/0311847 | A1 * | 10/2014 | Hillaert | A45C 5/14 190/18 A |
| 2015/0313338 | A1 * | 11/2015 | Lai | B29C 43/14 190/126 |
| 2016/0073754 | A1 * | 3/2016 | Xiaomin | A45C 5/02 190/18 A |

* cited by examiner

*Primary Examiner* — Sue A Weaver
(74) *Attorney, Agent, or Firm* — Karish & Bjorgum, PC

(57) ABSTRACT

A case with a transparent shell accommodates a sheet mounted within the shell to modify the appearance of the case. Magnetic coupling at the corner of the shells retains the sheet. Binding at the distal edge of the shell extends over the periphery of the sheet when placed within the transparent shell. The sheet may include visual information arranged to appear through the transparent shell.

6 Claims, 6 Drawing Sheets

CASE WITH TRANSPARENT SHELL

BACKGROUND OF THE INVENTION

The field of the present invention is carrying cases including luggage.

Carrying cases have been developed which include transparent windows or transparent shells for displaying visual information such as advertising and decorative indicia. The visual information is typically carried on a sheet and is placed within the case to show through the transparency. One such patent illustrating such a device is U.S. Pat. No. 9,066,566, entitled TRANSPARENT SHELL STRUCTURE FOR LUGGAGE AND THE LIKE, the disclosure of which is incorporated herein by reference.

SUMMARY OF THE INVENTION

The present invention is directed to a case including a transparent shell having a planar face and sidewalls extending laterally therefrom. Corners are formed by adjacent sidewalls and the planar face. Corner covers are fixed over the shell corners. A sheet is positionable within the shell. The corner covers include ferromagnetic elements with such elements over the planar face and the sidewalls adjacent the corners. Ferromagnetic elements are also arranged on the sheet such that these second elements are positionable to be aligned with the elements associated with the corner covers. One or the other or both of the sets of elements associated with the corner covers and with the sheet are magnetic. Binding may contain the periphery of the sheet In further aspects of the present invention, the sheet may include relief gaps positionable beneath the corners with ferromagnetic materials aligned. Flexible binding may be affixed to the distal edges of the shell sidewalls and extend over to receive the edges of the sheet when positioned with the ferromagnetic elements magnetically engaged. Visual information may be provided on the sheet to define such things as patterns, logos, personal photographs or artistic elements.

Accordingly, it is an object of the present invention to provide a convenient mechanism for decorating a transparent shell of a case. Other and further objects and advantages will appear hereinafter.

DETAILED DESCRIPTION OF A PREFERRED EMBODIMENT

Turning in detail to the drawings, a luggage case, generally designated 10, includes at least one transparent shell 12.

Figure 1:
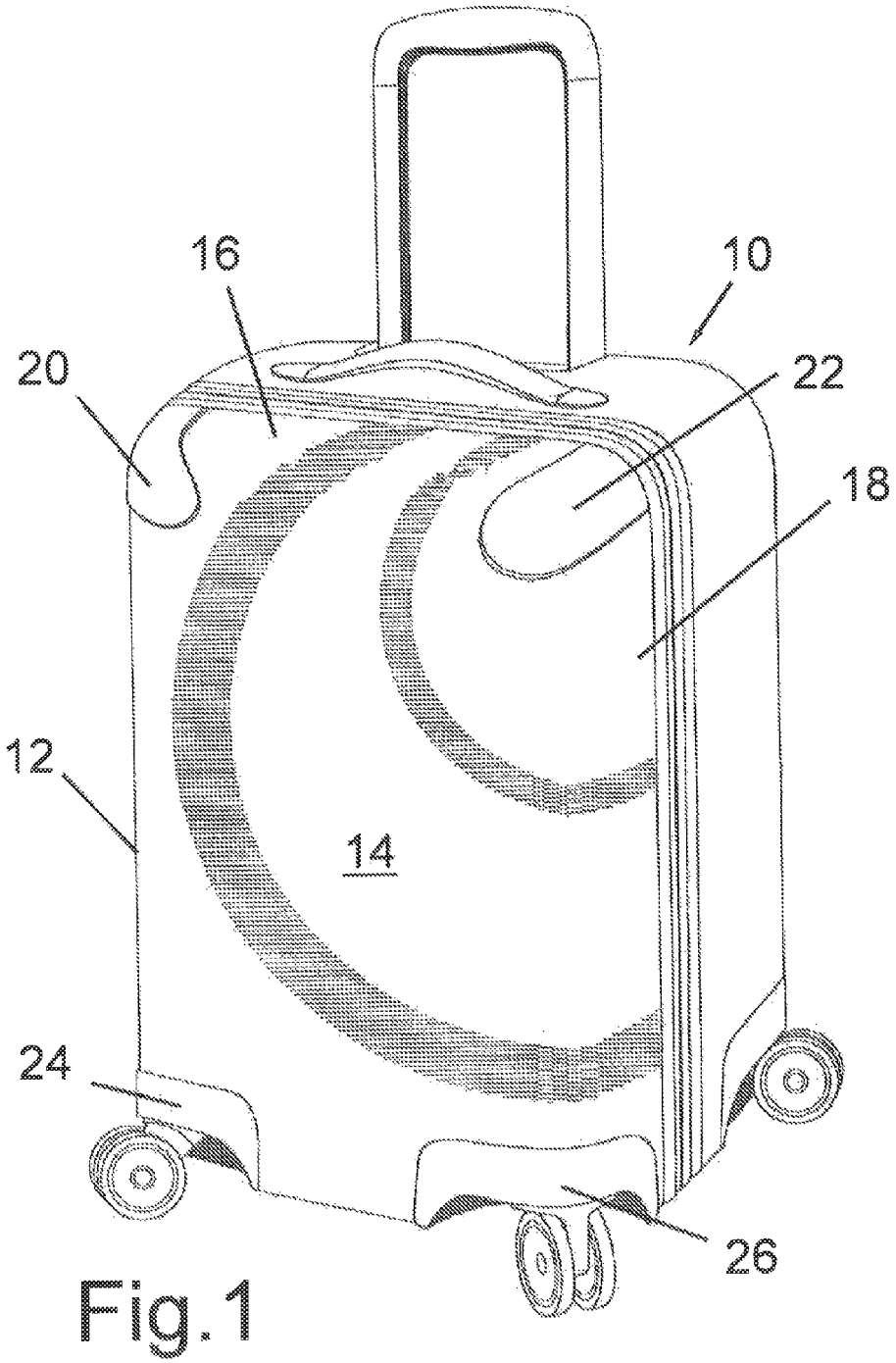
FIG. 1 is a common case with a transparent shell with corner covers or protectors as may include the invention.
Figure 2:
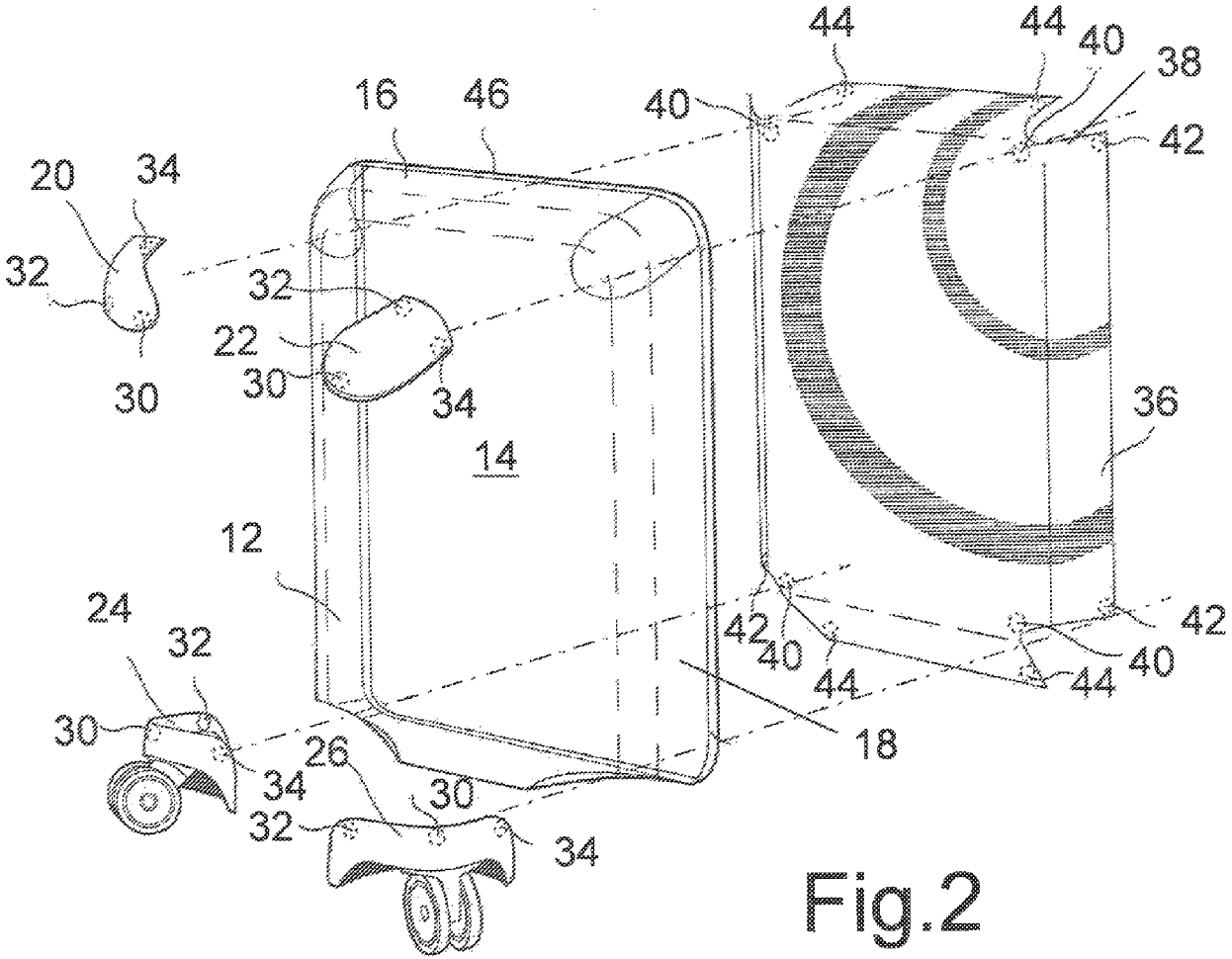
FIG. 2 is an exploded assembly perspective view illustrating corner covers, a transparent shell and a sheet.
Figure 3:
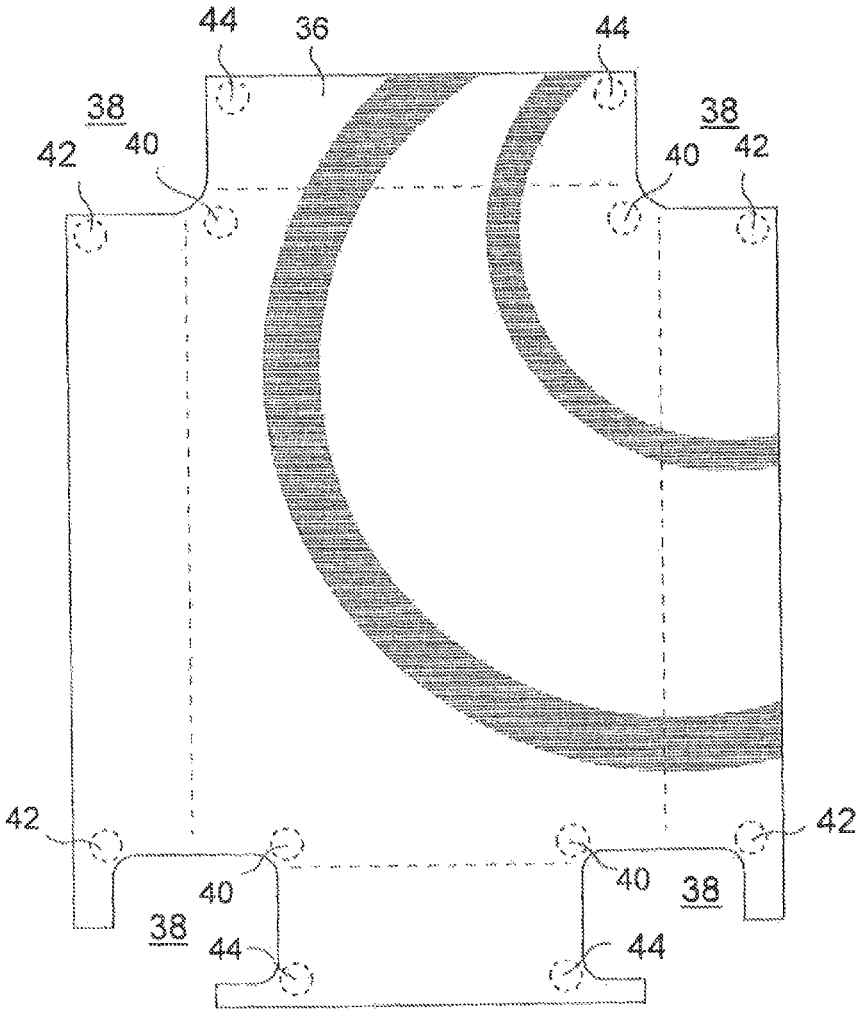
FIG. 3 is a plan view of a sheet.
Figure 4:
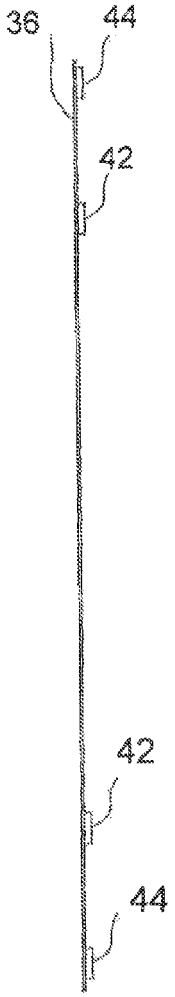
FIG. 4 is a side view of the sheet of FIG. 3.

The transparent shell includes a planar face 14. The planar face 14 may be flat or slightly bowed as are common in many typical cases. The transparent shell 12 is most conveniently of a unitary, formed rigid sheet but may be otherwise assembled. Extending laterally from the planar face 14 are top and bottom sidewalls 16 and side sidewalls 18. The transition between the planar face 14 and the sidewalls 16, 18 may be abrupt or a continuous curvature. In all events, the planar face 14, one of the top and bottom sidewalls 16 and one of the side sidewalls 18 define a closed corner. Four such corners are thus defined. Additional curvatures may accommodate specific elements such as the trucks illustrated in the case of FIG. 1.

Figure 5:
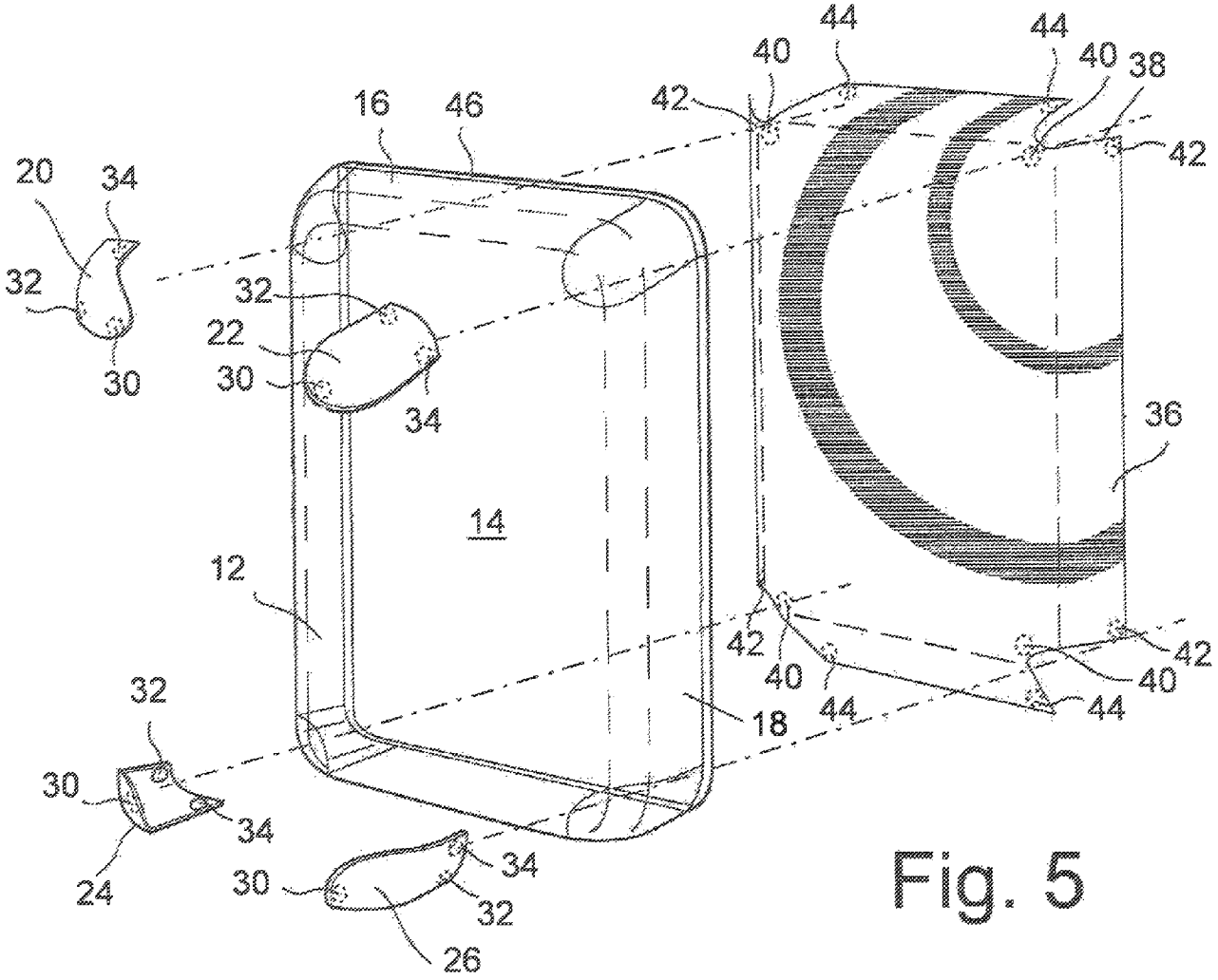
FIG. 5 is an exploded perspective view of a second embodiment illustrating corner covers, a transparent shell and a sheet.
Figure 6:
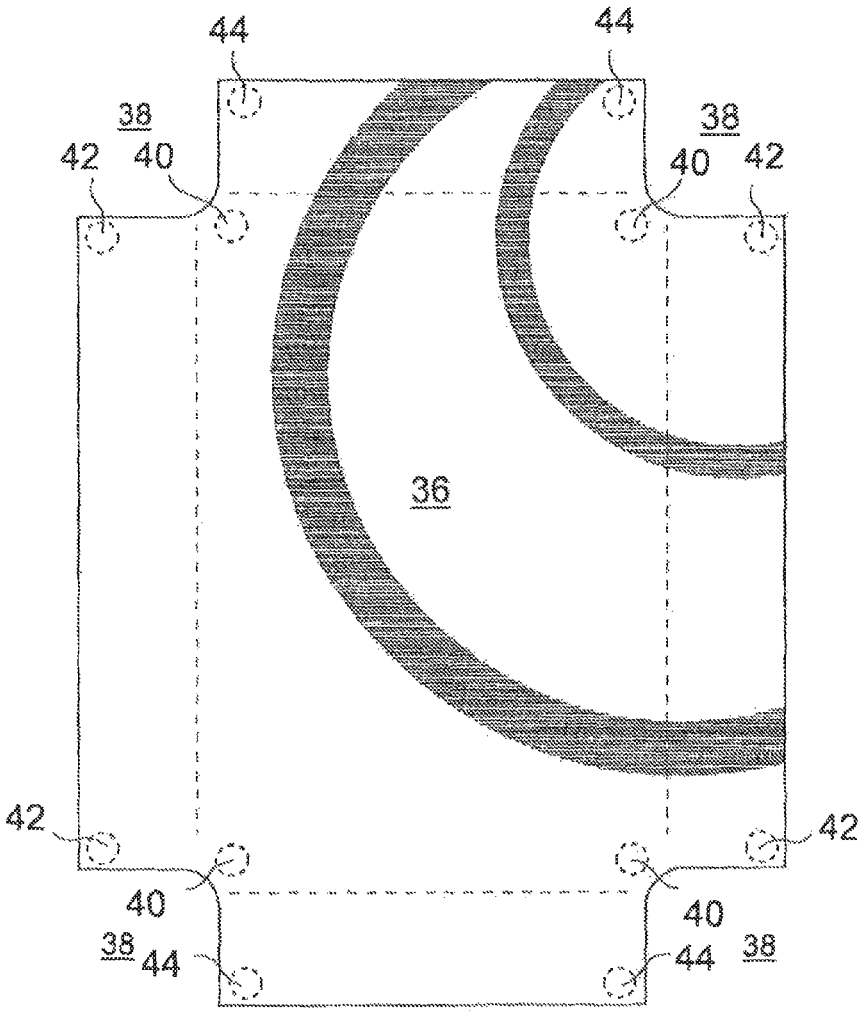
FIG. 6 is a plan view of the sheet of FIG. 5.
Figure 7:
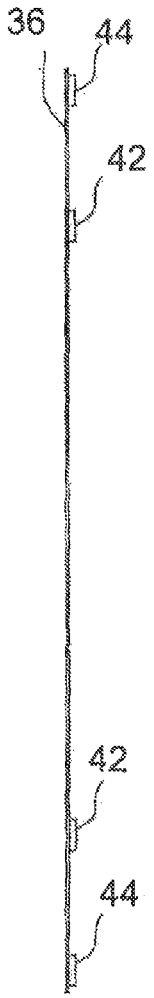
FIG. 7 is a side view of the sheet of FIG. 6.

Corner covers 20, 22, 24, 26 are arranged outside of the transparent shell 12 at the corners thereof. The corner covers 20, 22 at the top of the case are formed to match the curvature of the associated corners. The same is true for corner covers 24, 26 while accommodating the necessary space for the associated trucks in the first embodiment. The bottom sidewall 16 of the second embodiment illustrated in FIG. 5 is more similar to the top sidewall 16 as no trucks are to be accommodated.

Figure 8:
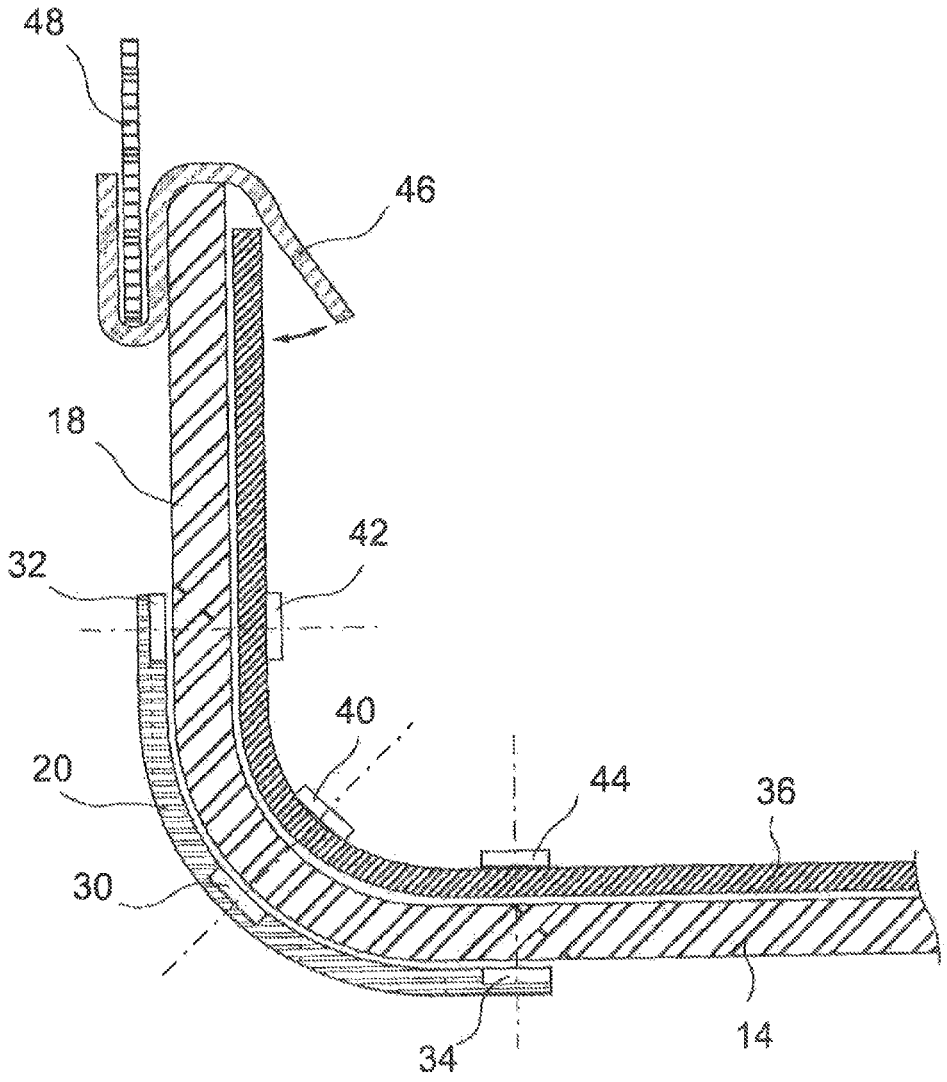
FIG. 8 is a warped-plane cross-sectional view illustrating placement of the ferromagnetic elements and binding with a transparent shell corner cover and sheet.

The corner covers 20-26 in this embodiment each include ferromagnetic elements 30, 32, 34. Three elements are shown associated with each corner cover. However, other configurations of such elements may be employed as needed or otherwise convenient, including a single contoured element fitting within the corner. The ferromagnetic elements 30, 32, 34 may either be magnetic or simply attract magnets. By being on the corner covers 20-26, these ferromagnetic elements 30-34 are positioned on the outside of the transparent shell 12. The elements are arranged such that the ferromagnetic element 30 is positioned on top of the planar face 14. The ferromagnetic elements 32, 34 are positioned over the top sidewall 16 and the side sidewall 18, respectively. As shown in FIG. 8, these ferromagnetic elements 30-34 are embedded within the corner covers 20-28 so as to be immediately next to the transparent shell 12 and may not to appear on the visible outward surface of the corner covers 20-26.

A sheet 36 is positioned inwardly of the transparent shell 12. The sheet 36 preferably includes a certain degree of rigidity such that it will lie closely against the planar face 14 and yet fit closely to the transitional curves between the planar face 14 and the sidewalls 16, 18. The sheet 36 includes a relief gap 38 at each of the corners of the sheet 36 which will correspond with the corners of the transparent shell 12 when the sheet 36 is positioned within the shell 12. The relief gaps 38 may take on convenient shapes to accommodate bending and placement of the sheet 36 as the resulting configurations of the gaps 38 will be reduced and fully covered by the adjacent corner cover 20-26.

The sheet 36 is shown to include ferromagnetic elements 40, 42, 44. These elements 40, 42, 44 are preferably adhered to the sheet 36 in positions so as to correspond with the positions of the ferromagnetic elements 30-34 of the corner covers 20-26 when the sheet 36 is fully positioned within the transparent shell 12. The ferromagnetic elements 40-44 associated with the sheet 36 may also or alternatively be magnetic and positioned to be attracted in magnetic coupling to the ferromagnetic elements 30-34. In this embodiment, the ferromagnetic element 40 is located adjacent the apex of the relief gap 38 while the ferromagnetic elements 42, 44 are positioned to either side of the relief gap 38.

At the distal edges of the sidewalls 16, 18, which provide a continuous periphery at the opening of the transparent shell in the preferred embodiments, flexible binding 46 is attached to the outside of the sidewalls. The fixing of the flexible binding 46 to the transparent shell 12 may be by any common means in case construction including bonding, stitching, fasteners or an integral bead. The flexible binding extends in a fold over the distal edges of the sidewall into the inner side of the transparent shell 12 as can be seen in FIG. 8. The flexible binding 46 also extends outwardly through a second loop to form an attachment to capture a case zipper 48 to be affixed thereto by stitching or other means.

The binding 46 may cover the peripheral edges of the sheet 36 when the sheet is fully positioned within the transparent shell 12. The rigidity of the flexible binding 46 may be selected for retaining the edges of the sheet 36 to prevent the sheet 36 from moving toward the distal end of the sidewalls, indicated by the arrow in FIG. 8. With a properly fitted sheet 36, the magnetic coupling of the ferromagnetic elements and the effective retention by the flexible binding 46 can result in the sheet 36 appearing as substantially one with the transparent shell 12 in outward appearance. The sheet 36 may provide the observable visual information and may be used as a backing for another, possibly less rigid sheet with selected visual information thereon. This alternative use allows flexibility in the selection of images and yet can provide a proper fit and rigidity to the sheet 36 for secure and well positioned placement for the best visual effect.

Thus, an improved easily installed decorative feature may be positioned in the transparent shell of a case. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A case comprising a transparent shell including a planer face and sidewalls extending laterally of the planer face about a periphery of the planar face, the sidewalls and the planar face forming at least two corners on the transparent shell;

corner covers outwardly of the transparent shell over each of the formed corners, respectively, each corner cover including first ferromagnetic elements over the planar face and the sidewalls, respectively;

a sheet positionable inwardly of the transparent shell including second ferromagnetic elements alignable under the planar face with the first ferromagnetic elements, respectively, one or both of the first and second ferromagnetic elements each being magnetic;

binding fixed at distal edges of the sidewalls, the sheet being positionable under the binding with the first and second ferromagnetic elements magnetically engaged.

2. The case of claim 1, the binding being fixed to the sidewalls on the outside of the transparent shell and extending over the distal edges to the inside of the transparent shell.

3. The case of claim 2, the binding extending in a loop outwardly of the transparent shell to form an attachment for a zipper.

4. The case of claim 1, the sheet including a relief gap positionable beneath each of the corner covers, respectively.

5. The case of claim 1, the sheet including decorative indicia positionable in the transparent shell against the planar face.

6. A case comprising a transparent shell including a planer face and sidewalls extending laterally of the planer face about a periphery of the planar face, the sidewalls and the planar face forming at least two corners on the transparent shell;

corner covers outwardly of the transparent shell over each of the formed corners, respectively, each corner cover including first ferromagnetic elements over the planar face and the sidewalls, respectively;

a sheet positionable inwardly of the transparent shell including second ferromagnetic elements alignable under the planar face with the first ferromagnetic elements, respectively, one or both of the first and second ferromagnetic elements each being magnetic, the sheet including a relief gap positionable beneath each of the corner covers, respectively;

flexible binding fixed at distal edges of the sidewalls on the outside of the transparent shell and extending over the distal edges to the inside of the transparent shell, the sheet positionable under the flexible binding with the first and second ferromagnetic elements magnetically engaged.

* * * * *